United States Patent [19]

Long

[11] Patent Number: 4,539,923

[45] Date of Patent: Sep. 10, 1985

[54] SELF-THREADING NEEDLE

[75] Inventor: Ballard E. Long, Oak Ridge, Tenn.

[73] Assignees: A. LaSelva, Chattanooga; L. Lockard, Clinton; E. Roberts, Ten Mile, all of Tenn.

[21] Appl. No.: 601,009

[22] Filed: Apr. 16, 1984

[51] Int. Cl.[3] ..... D05B 85/02

[52] U.S. Cl. ..... 112/224

[58] Field of Search ..... 112/224, 222; 223/102

[56] References Cited

U.S. PATENT DOCUMENTS

| | | | |
|---|---|---|---|
| 775,036 | 11/1904 | Hall | 112/224 |
| 1,323,340 | 12/1919 | Weis | 112/222 |
| 1,924,378 | 8/1933 | Rattie | 112/224 |
| 3,265,021 | 8/1966 | Matthews | 112/222 X |
| 4,385,575 | 5/1983 | Weber | 112/224 |
| 4,458,614 | 7/1984 | Iwashita | 112/222 |

FOREIGN PATENT DOCUMENTS

| | | | |
|---|---|---|---|
| 635263 | 1/1935 | Fed. Rep. of Germany | 112/222 |
| 2812857 | 10/1978 | Fed. Rep. of Germany | 112/222 |
| 436842 | 4/1912 | France | 112/224 |
| 1064378 | 5/1954 | France | 112/224 |
| 13733 | of 1907 | United Kingdom | 112/224 |

*Primary Examiner*—Werner H. Schroeder
*Assistant Examiner*—Andrew M. Falik
*Attorney, Agent, or Firm*—Alan Ruderman

[57] ABSTRACT

A self-threading needle has a threading slot entering into the upper portion of the needle eye at approximately two thirds from the bottom of the eye, and has a point offset relative to the axis of elongation of the needle toward the same side of the needle from which the slot enters the eye. The slot lies in a plane substantially normal to the axis of the needle and to the wall of the needle in which the slot is formed. The needle includes a clearance above the eye and a thread accommodating groove.

15 Claims, 5 Drawing Figures

SELF-THREADING NEEDLE

BACKGROUND OF THE INVENTION

This invention relates to sewing needles and the like and more particularly to a easy-threading needle of this type having a threading slot opening into the needle eye and a piercing point offset relatively to the needle axis and the eye toward the slotted side of the needle.

Ever since the invention of the sewing needle, the problem of threading the needle has existed. This is especially true in manufacturing facilities which perform stitching operations for the garment trades. Whenever a thread breaks, or a bobbin or spool runs out of thread, or a needle unthreads, the operator must go through the distressful threading operation of inserting the thread through the needle eye. The same problem is presented in tufting mills where a yarn must be threaded through a needle eye.

Although there has been a long felt need for a satisfactory solution to the threading problem, no such solution has been provided by the prior art. The prior art is inundated with various proposals and attempts directed toward a solution to this problem, but no known proposal has been found satisfactory, and at this time no known needle is being sold which overcomes the threading problem.

As exemplary of the prior art are the following United States patents which extend chronologically from 1963 through 1983 and illustrate the many attempts at a solution: U.S. Pat. Nos. 37,996 (Ambler); 497,926 (Piffard); 623,666 (Hodsdon et al); 653,886 (Roberts); 738,567 (Olsen); 1,235,751 (Yount); 1,878,915 (Trejo); 1,926,378 (Rattie); 2,221,419 (Antcliff); 2,561,502 (Diemer); 3,858,537 (Zocher) and 4,385,575 (Weber).

Inherent in the design of the known prior art easy threading or so called "self-threading" needles is that the thread tends to escape from the needle when back-tacking, i.e., sewing in reverse, and that they either have sharp projections or indentations which tend to snag on the fabric as it passes therethrough. Other problems involve chafing and tearing of the thread. In most of the prior art attempts the thread is directed into the needle eye through a thread slot. In the prior art attempts have been made to smooth or bevil the edges of the slot which actually has resulted in the strands of the fabric being guided into and snagged by the edges of the slot. In other of the prior art, thread and fabric protection has been provided by spring type members which normally close the slot thereby either making it impractical to construct or provide a notch type indentation which can not tolerate side pressures on the needle. In almost all of the known prior art the point of the needle is in line either along the axis of the needle, or offset but aligned with the axis of the eye as in Weber, and as the thread tends to ride up the wall of the yee on the needle down stroke, there is a tendency for the thread to slip out of the threading slot. Moreover, in the known patented art in which the thread slot enters directly into the needle eye, the slot is at or below the longitudinal center of the eye which has a tendency to result in jerking the thread out of the slot on the needle upstroke, especially when back-tacking.

Additionally, of the known needles that have been marketed in the past, satisfactory results would occur, if at all, only in certain types of sewing machines, such as certain of those having a hook rotatable about a horizontal axis. The known prior art needles that have been attempted to be used with the vertical axis hooks have not been satisfactory.

SUMMARY OF THE INVENTION

Consequently, it is a primary invention to provide an easily threadable needle having a construction which precludes escape of the thread from the needle eye, excessive tearing of the thread and ripping of the material being sewn.

It is another object of the present invention to provide an easy threading needle in which the thread does not escape from the needle eye when back-tacking.

It is a further object of the present invention to provide an easily threadable needle which sews satisfactorily with a multitude of sewing machines.

It is a still further object of the present invention to provide a needle in which a threading slot enters the eye of the needle from the side above the center of the eye relative to the point, and the point is offset relative to the eye to the side of the needle from which the thread slot enters the eye.

Accordingly, the present invention provides a needle having a threading slot entering the needle eye from a disposition substantially normal to the adjacent edge of the needle at one side thereof and above the center of the eye, and a point offset relative to the needle eye toward the same side from which the slot enters the eye. Preferably, the thread slot enters the eye at about two thirds the distance of the longitudinal length of the eye as measured from the bottom of the eye. Moreover, the eye is preferably axially elongated along the same axis as the longitudinal axis of the needle so that the needle point is offset relatively to the needle axis toward the same side as the thread slot. With this construction the relationship of the hook clearance above the eye to the thread slot is such that the hook can not force the thread to be extracted through the slot while the off-center point appears to cause the thread limb which comes directly from the thread source to extend about the needle at the side opposite the slot such that the thread is not jerked out of the slot when sewing in reverse or back-tacking.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
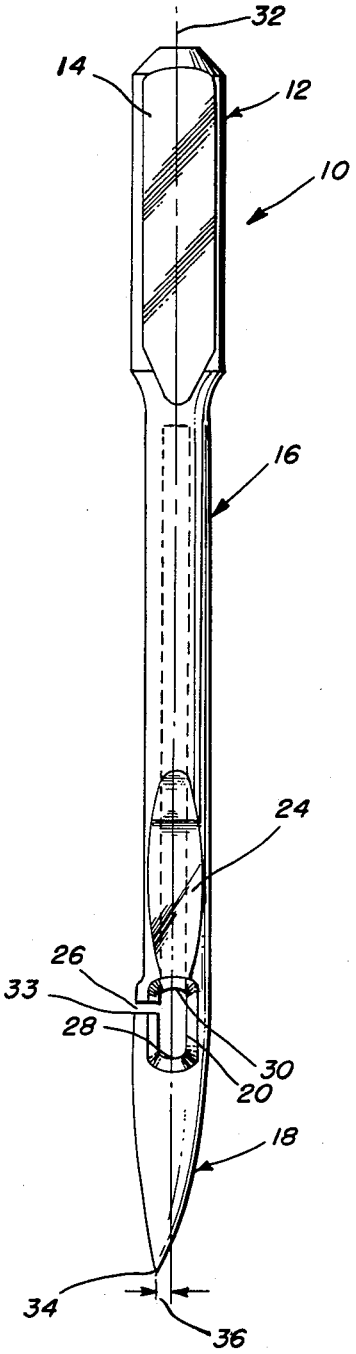
FIG. 1 is an elevational view of an easy threading sewing machine needle constructed in accordance with the principles of the present invention as viewed from a position looking into the eye.

Referring now to the drawings, a needle 10 constructed in accordance with the principles of the present invention may take the form of a sewing needle as illustrated or may be in a form of other similar needles such as a tufting needle. As illustrated, the needle 10 comprises an elongated body member having a substantially cylindrical shank 12 at the upper end which may have a flat slab portion 14 as is generally utilized in domestic-type sewing machine needles for orientation and location in a sewing machine. The shank thereafter is pinched down to an elongated blade portion 16 which extends away from the shank and terminates in a point portion 18 at the extremity remote from the shank. Adjacent the point portion 18 the blade is formed with a transverse eye 20 adapted for receiving thread as is well known in the art.

On one side of the needle a long thread accomodating groove 22 extends the length of the blade 16 and opens into the eye 20 for reasons well known in the art so as to protect the thread as the needle penetrates the material in which the stitches are made. On the side opposite that side on which the thread accomodating groove 22 extends, the needle is formed with a recess or clearance portion 24 which provides the clearance for the hook for a sewing machine to enter for loop seizure, this clearance 24 generally being known in the art as the clearance above the eye.

To facilitate insertion of a thread T into the eye 20 the blade is formed with a thread slot 26 which enters into the upper portion of the needle eye. Preferably the slot 26 enters the needle eye at approximately two-thirds the length of the eye as measured from the bottom 28 of the eye 20. Thus, the location at which the slot 26 enters the eye 20 as measured from the lower end 28 of the eye 26 is approximately two-thirds the axial length of the eye from the lower end 28 to the upper end 30 of the eye. Since the clearance above the eye 24 terminates at the eye 20, the thread slot 26 is approximately one-third the axial length of the eye from the clearance above the eye. The slot 26 should be substantially square to the side of the needle, that is the slot 26 is substantially normal to the longitudinal axis 32 of the needle and sharply intersects the outer wall of the needle such as at 33 from whence the slot extends. In this manner strands of the material through which the needle penetrates will not be guided or directed into the slot 26. Furthermore, the slot 26 is relatively narrow and preferably is approximately that of the diameter of the thread and preferably is forced open further when the thread is pulled into the slot and springs back to narrow the slot when the eye is threaded.

Figure 2:
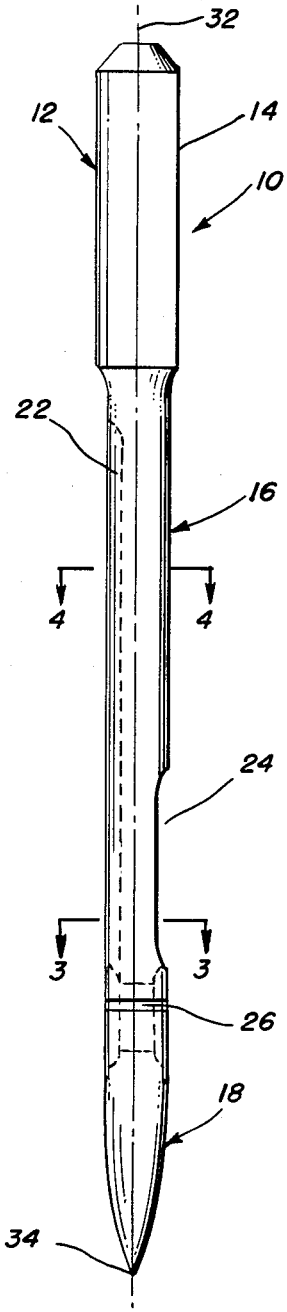
FIG. 2 is a view similar to FIG. 1 but with the needle rotated 90° about the longitudinal axis and looking into the threading slot.
Figure 3:
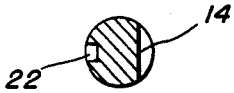
FIG. 3 is a cross sectional view taken substantially along line 2—2 of FIG. 2.
Figure 4:
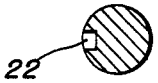
FIG. 4 is a cross sectional view taken substantially along line 4—4 of FIG. 2.
Figure 5:
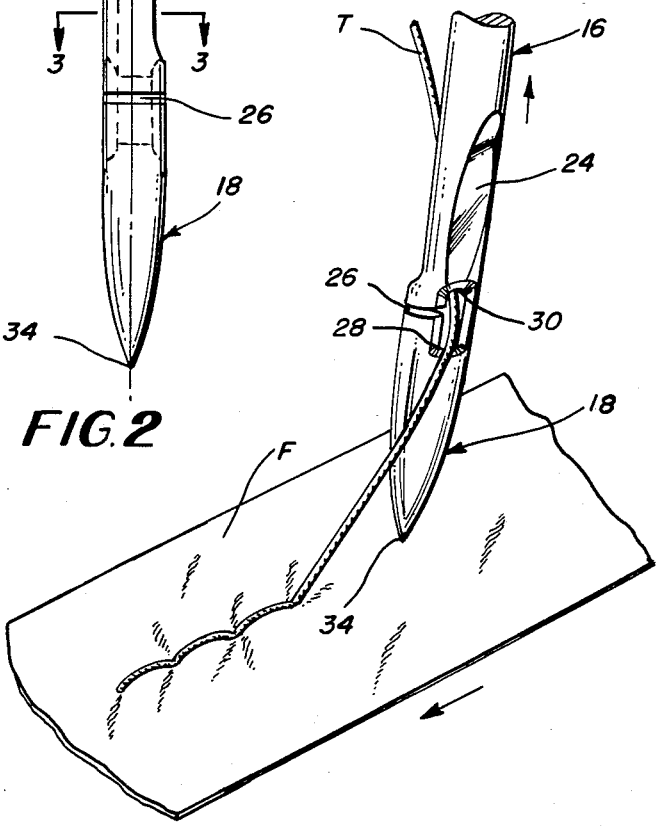
FIG. 5 is a fragmentary perspective view of the pointed end of the needle illustrating the disposition of the thread while the needle is sewing in reverse, the needle being illustrated in the ascending position.

To ensure that the thread does not jerk out of the eye 20 through the slot 26 to point portion 18 is off-center relative to the needle axis 32 toward the side of the needle from which the slot 26 enters the eye. Thus, the piercing point 34 of the needle is offset relative to the axis of the needle by an amount indicated at 36 in FIG. 1 and thus is toward the side of the needle from which the slot 26 enters the eye 20. With such a construction the problem of reverse sewing encountered by the prior art needles is avoided. It is theorized that the thread is forced to swing about the needle to the unslotted side when sewing in reverse and is not jerked out. Moreover, in reverse sewing when the needle is retracted and is ascending through the fabric F, as illustrated in FIG. 5, the thread as it is pulled toward the bottom of the eye is moved from the slot which is at the upper portion of the eye and when the needle descends to penetrate the backing, the tension on the thread is such that the thread is not pulled toward the slot 26. It may be noted that the needle axis 32 and the point 34 are aligned when viewed in the direction transverse to the direction in which the slot opens as illustrated in FIG. 2. That is, a longitudinal plane carrying the needle axis 32 and intersecting the longitudinal walls of the eye also extends through the point 34 of the needle. As illustrated and viewed in FIG. 1 a plane parallel to the needle axis and passing through the point 34 is spaced from the needle axis by an amount indicated at 36. Although for purposes of illustration the drawings may exaggerate the amount 36 by which the point 34 is offset from the needle axis 32, it should be understood that this amount is relatively small and may not be greater than half the width of the needle eye. The exact amount of the offset 36 is dependent upon the size of the needle and may depend upon various sewing parameters.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An easy threading sewing needle or the like comprising a body member having a longitudinally elongated axis, a shank at one extemity of said body member adapted to be clamped in a sewing machine or the like, a blade extending from the shank and terminating in a pointed extremity remote from the shank, an eye adapted for receiving threads or the like comprising an aperture defined intermediate spaced wall portions of said blade and defining upper and lower eye surfaces, said eye having an axis of elongation substantially parallel to the axis of said needle extending through said upper and lower surfaces intermediate said wall portions, a longitudinally extending thread accomodating groove extending along a surface of said blade intermediate said wall portions and opening into said eye, a recess formed in the blade above the eye defining a hook receiving clearance on the surface of the needle disposed oppositely relative to said groove, a thread inlet slot formed transversely in the needle blade extending through one of said wall portions from one side of said needle substantially normal to said axes and opening into said eye, said one side being disposed intermediate the surfaces on which said groove and said recess are formed, said slot terminating intermediate the upper and lower extremities of said one wall portion of said eye closer to said upper surface than to said lower surface, and said pointed extremity terminating in a piercing point offset from the axis of elongation of said eye toward said one wall portion.

2. An easy threading sewing needle or the like as recited in claim 1, wherein said slot enters said eye at a disposition approximately two-thirds the axial length of said eye.

3. An easy threading sewing needle or the like as recited in claim 2, wherein said axis of said eye is coincident with the axis of said needle.

4. An easy threading sewing needle or the like as recited in claim 3, wherein said hook clearance is transversely offset from said point.

5. An easy threading sewing needle or the like as recited in claim 3, wherein said slot sharply intersects the surface of said needle at said one side.

6. An easy threading sewing needle or the like as recited in claim 1, wherein said axis of said eye is coincident with the axis of said needle.

7. An easy threading sewing needle or the like as recited in claim 1, wherein a common plane intersecting said wall portions, passing intermediate said groove and said recess, and carrying said axis of the needle extends through said point.

8. An easy threading sewing needle or the like as recited in claim 7, wherein said slot enters said eye at a disposition approximately two-thirds the axial length of said eye.

9. An easy threading sewing needle or the like as recited in claim 8, wherein said axis of said eye is coincident with the axis of said needle.

10. An easy threading sewing needle or the like as recited in claim 9, wherein said hook clearance is transversely offset from said point.

11. An easy threading sewing needle or the like as recited in claim 9, wherein said slot sharply intersects the surface of said needle at said one side.

12. In a sewing needle or the like having a body member including a longitudinally elongated axis, a mounting shank at one end of the body member and a point at the opposite end, said shank and said point being separated by a blade, an eye formed in said blade adjacent the point for receiving thread or the like, said eye having an axis of elongation substantially coincident with the axis of said needle, a longitudinally extending thread accomodating groove extending along a surface of said blade and opening into said eye, and a recess formed in the blade above the eye defining a hook receiving clearance on the surface of the needle disposed oppositely relative to said groove, the improvement comprising, a slot extending from one side of the needle into the eye at a location disposed above the center of the eye relatively to the axis of elongation, said side being disposed intermediate the surfaces on which said groove and said recess are formed, said slot lying in a plane substantially normal to the axis of said needle, and said point lying in a plane parallel to and offset from said axis toward said one side of said needle.

13. In a sewing needle or the like as recited in claim 12, wherein said slot enters said eye at a disposition approximately two-thirds of the axial length of said eye above the portion of the eye most adjacent the point.

14. In a sewing needle or the like as recited in claim 12, wherein said slot sharply intersects the surface of said needle at said one side.

15. In a sewing needle or the like as recited in claim 13, wherein said slot sharply intersects the surface of said needle at said one side.

* * * * *